US006199419B1

(12) United States Patent
Shrayer et al.

(10) Patent No.: US 6,199,419 B1
(45) Date of Patent: Mar. 13, 2001

(54) METHOD FOR MANUFACTURING A DOME FROM AN UNDERSIZED BLANK

(76) Inventors: Emmanuil Shrayer, 16 Rawson Ave., Lexington, MA (US) 02420; Richard J. Morganti, 11 Champa Rd., Billerica, MA (US) 01821

( * ) Notice: Subject to any disclaimer, the term of this patent is extended or adjusted under 35 U.S.C. 154(b) by 0 days.

(21) Appl. No.: 09/421,830

(22) Filed: Oct. 20, 1999

Related U.S. Application Data

(63) Continuation-in-part of application No. 09/067,297, filed on Apr. 27, 1998, now Pat. No. 6,006,569.

(51) Int. Cl.[7] ..... B21H 1/00
(52) U.S. Cl. ..... 72/69; 72/85
(58) Field of Search ..... 72/68, 69, 83, 72/85

(56) References Cited

U.S. PATENT DOCUMENTS 3,815,395 * 6/1974 Sass ..... 72/69
4,170,889 * 10/1979 Tanimoto et al. ..... 72/85

* cited by examiner

*Primary Examiner*—Lowell A. Larson
(74) *Attorney, Agent, or Firm*—William B. Ritchie

(57) ABSTRACT

Disclosed is a method of forming a dome from a substantially round blank having a surface area smaller than the surface area of the dome. The method includes the steps of shear forming the blank to form a deformed blank, spin stretching the deformed blank in selected areas along its circumference to form a stretched blank, inside spinning the stretched blank into a rough dome, final dome spinning the rough dome into the finished dome, and flange spinning the dome.

17 Claims, 9 Drawing Sheets

METHOD FOR MANUFACTURING A DOME FROM AN UNDERSIZED BLANK

REFERENCE TO RELATED APPLICATIONS

This application is a continuation in part of U.S. patent application Ser. No. 09/067,297, filed Apr. 27, 1998, now U.S. Pat. No. 6,006,569.

FIELD OF THE INVENTION

This present invention relates to the manufacture of large metallic dome structures, and in particular to a method of manufacturing rockets domes from undersized blanks.

BACKGROUND OF THE INVENTION

Advancements in satellites, and the enhancements to telecommunications and other services that sophisticated satellites make possible, have dramatically increased the number of commercial satellites being launched. As each launch is an expensive event, there has been a trend toward increasing the number of features and components on satellites, allowing multiple users to share the costs and benefits of the satellite launch. Increased features have resulted in an increase in the size of these satellites, and consequently the size of the launch vehicles required to carry these satellites into their operational orbit. Generally, satellite launch vehicles are multi-stage rockets, with each stage including its own fuel tank, with domes. It is in the manufacture of these larger rocket domes that current manufacturing methods fall short.

Rocket domes have typically been fabricated from single blanks of aluminum alloys or other alloys that are hot spun over mandrels to form the desired shape. Common mandrel spinforming methods include clamping a blank between a rotatable spindle and a die, or mandrel, corresponding to the shape to be formed. The clamped assembly is then rotated and the blank is heated while a tool, such as a spinning roller, is used to apply pressure, progressively, to a small area of the metal blank, thereby causing the small area to deform in the direction of the pressure. As the metal blank rotates, a circumferential band of the blank is progressively deformed and, by moving the spinning roller in a radial direction with respect to the rotating metal blank, the desired shape is produced.

Other spinning methods, such as those described in U.S. Pat. Nos. 5,235,837 and 5,426,964, utilize a numerically controlled second roller in place of the mandrel to exert directed forces on both sides the blank to deform the material in the desired manner. These methods are useful for cold rolling exotic materials, or for hot rolling tanks or other pressure vessels. However, dual roller systems have not traditionally been used in the production of rocket domes of the characteristics described herein. The use of this type of equipment for very large domes will necessitate welding a flange to the polar and equatorial region of the dome. Also, if dome configuration had nozzles with the dome shell, this would also have to be welded into place.

Traditionally, rocket domes have been manufactured by the mandrel spinning process from blanks having a surface area that is greater than or equal to the surface area of the domes to be spun. This process results in a dome having the desired diameter and a substantially constant material thickness. Traditional hot mandrel spinning methods have been effective, as long as the surface area of the necessary blank was smaller than the largest commercially available blank diameter. However, to manufacture domes for large rockets using traditional mandrel spinning techniques would require a circular blank with an outside diameter well in excess of the maximum commercially available blank size.

One possible solution to this problem is to weld several blanks together to provide a starting outside diameter of sufficient size. However, this is a very expensive approach due to the meticulous processes that must be employed to insure the integrity of the welds, and the subsequent x-raying and testing required to qualify each weld.

Another solution would involve the production of a rolling press that could produce plates of the desired thickness having diameters in excess those that are currently commercially available. However, neither material fabricators nor spinning manufacturers are likely to invest in such a press as the low demand for plates of these widths, and the high cost of designing and building this equipment, make this solution an unprofitable one.

A method of manufacturing a rocket dome from an undersized blank that does not require multiple blanks to be welded together, does not require blanks to be rolled to the desired diameter, and may be performed on common hot mandrel spinning equipment is not known in the art.

SUMMARY OF THE INVENTION

Disclosed is a method of forming a dome from a substantially round blank having a surface area less than the surface area of the dome. She basic embodiment of the method includes the steps of shear forming, spin stretching the deformed blank in selected areas along its circumference to form a stretched blank, inside spinning the stretched blank into a rough dome, final dome spinning the rough dome into the finished dome and flange spinning the flange area of the dome.

In the preferred embodiment of the methods the shear forming step comprises the steps of coaxially securing an inside surface of the blank to a rotatable flat-nosed conical mandrel rotating the blank on the flat-nosed conical mandrel, heating a predetermined portion of the blank, and applying a force to an outer surface of the blank such that the blank is deformed in a shape of the flat-nosed conical mandrel to form the deformed blank. In this embodiment, the spin-stretching step involves spin-stretching the blank in predetermined locations to form a stretched blank having a surface area that is substantially equal to the surface area of the dome. The preferred inside spinning step involves coaxially securing an outside surface of the stretched blank within a rotatable concave dome mandrel, rotating the blank oil the concave dome mandrel, heating a predetermined portion of the stretched blank, and applying a force to an inner surface of the stretched blank such that the stretched blank is deformed to form a dome shaped blank. The inside-spinning, step is necessary for transformation of the conical shape of the blank after shear forming and spin stretching into a dome shape. Finally it is preferred that finish spinning step comprises the steps of coaxially securing the inside surface of the dome shaped blank to a rotatable convex dome mandrel, rotating the dome shaped blank on the convex dome mandrel, heating a predetermined portion of the dome shaped blank, applying a force to the outside surface of the dome shaped blank such that the dome shaped blank is deformed in a shape of the convex dome mandrel to form the dome.

The method of the present invention allows a rocket dome having desired mechanical properties to be manufactured from a blank having a surface area smaller than the desired dome surface area and without incurring the high costs of welding multiple blanks, manufacturing and operating an oversized roller to produce oversized blanks, or purchasing expensive dual-roller spinning machinery.

Therefore, it is an aspect of the present invention to provide a method for manufacturing rocket domes from blanks having a surface area smaller than the desired dome surface area that results in domes having desired mechanical properties.

It is a further aspect of the present invention to provide a method for manufacturing rocket domes from blanks having a surface area smaller than the desired dome surface area that does not require welding multiple blanks together.

It is a further aspect of the present invention to provide a method for manufacturing rocket domes from blanks having a surface area smaller than the desired dome surface area that does not require blanks to be rolled to a size larger than the maximum available blank size.

It is a further aspect of the present invention to provide a method for manufacturing rocket domes from blanks having diameters smaller than the desired dome diameters that does not require the use of dual-roller roller spinning machinery.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
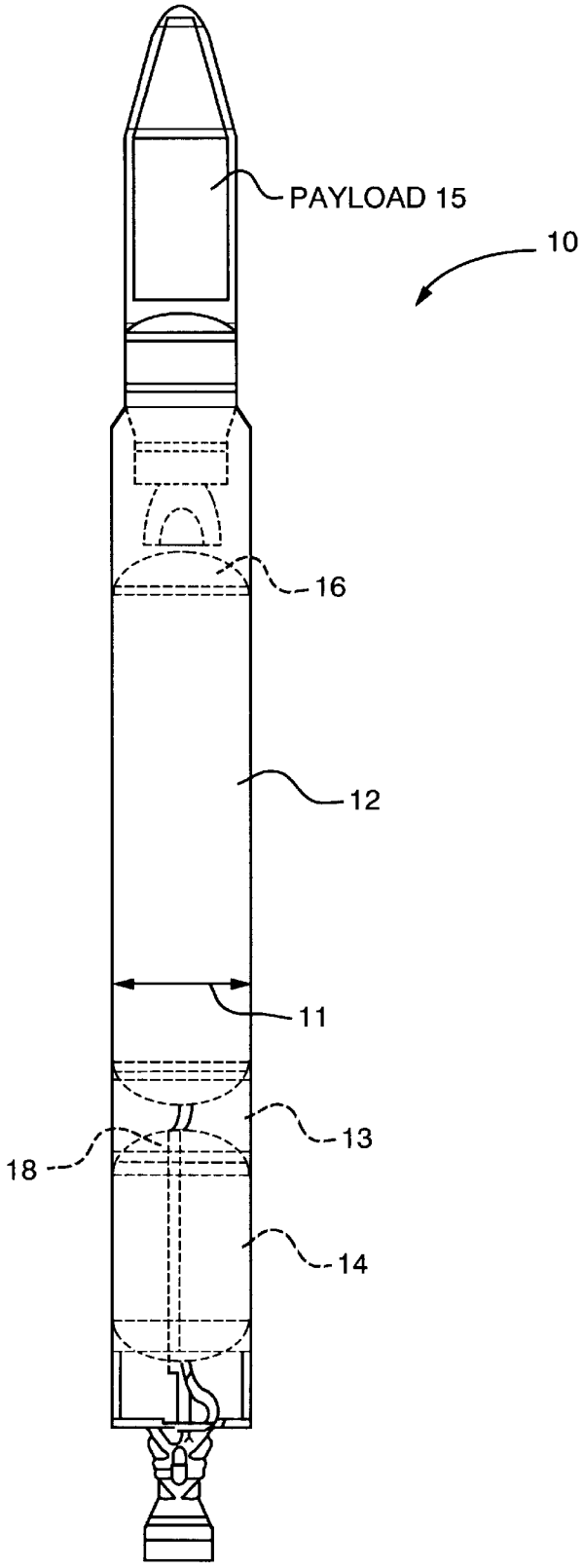
FIG. 1 is a pictorial illustration of a multi-stage rocket, wherein at least one of the stages includes a fuel tank having domed top and bottom surfaces.

FIG. 1 is a pictorial illustration of a multi-stage rocket 10. Rocket 10 includes an oxygen tank 14 and a hydrogen tank 12, joined by connecting space 13, and a payload 15. Oxygen tank 14 and hydrogen tank 12 are substantially cylindrical structures having a diameter 11 and having domes 18, 16 at the top and bottom of each respective tank. In rockets of this type, it is common for domes 18, 16 to have a diameter 11 in excess of the maximum available blank size, and it is to the manufacture of these domes 16, 18 that the present invention is directed.

Figure 2:
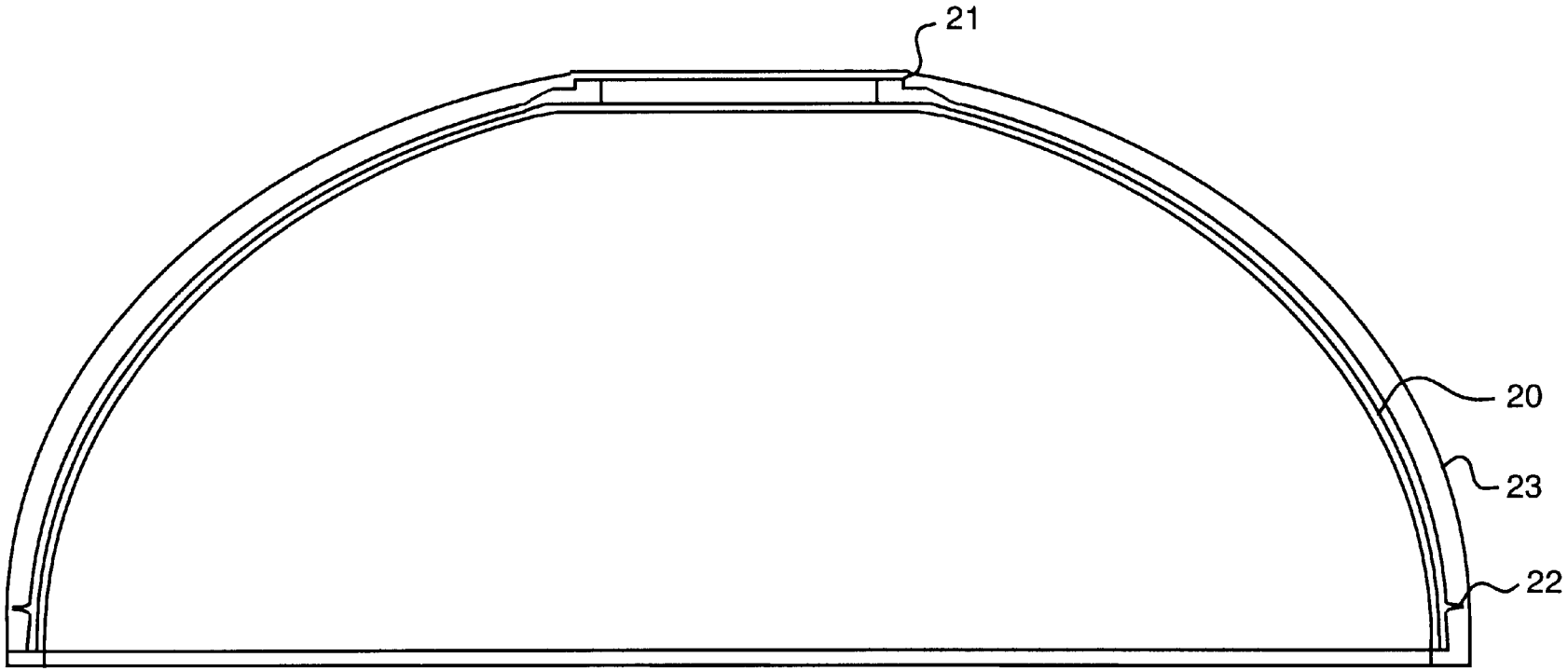
FIG. 2 is a cross sectional view of a dome that has been spun utilizing prior art spinning methods superimposed over a cross sectional view of a dome manufactured according to the method of the present invention.

Referring now to FIG. 2, a cross sectional view of an unmachined dome that has been spun utilizing prior art spinning methods is shown superimposed over a cross sectional view of a finished machined dome. Prior art dome 23 is spun using known techniques and results in a spun dome having a constant thickness. The thickness of the prior art dome 23 is chosen based upon the thickness requirement at the thickest point plus machining allowance. The thickest points of the dome are the Y-Cord or Flange at the equator and/or the Manhole Flange at the apex. Therefore certain portions of the dome are much thicker than necessary, for final machining. The dome 20 of the present invention, however, does not have a constant thickness, but rather has a thickened portion 26 around the manhole at the apex of the dome, a thin wall membrane 24 along the sides, and a thickened flange area 25 for connecting the dome to the cylindrical body of the tank. The thin wall membrane dome 24 is the location of shear and stretch spinning, thus allowing the use of a smaller starting material blank. These starting blanks would be smaller than those used for traditional spinning.

Figure 3:
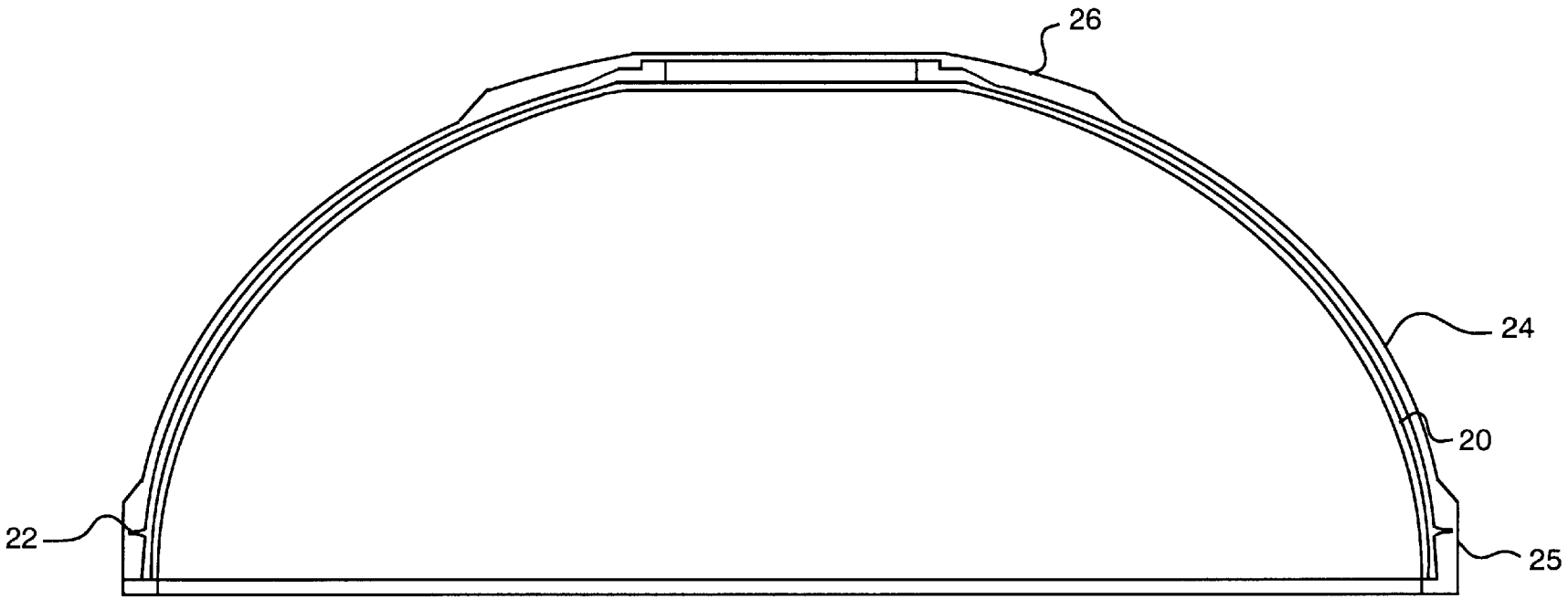
FIG. 3 is a cross sectional view of a dome that has been spun utilizing the method of the present invention.

Referring now to FIG. 3, is a cross sectional view of an unmachined dome that has been spun utilizing the method of the present invention superimposed over the finished rocket dome the same as of FIG. 2. As shown in FIG. 3, the spun dome 24 includes a thickened region 26 around the manhole area and a second thickened region 25 around the flange area. These thickened regions have a thickness equal to the thickness of the unspun blank and are machined using conventional techniques to produce the finished flange 22 and manhole area 21. In the membrane area 24 the spun dome is substantially thinner due to the shear and stretch spinning processes.

Figure 4:
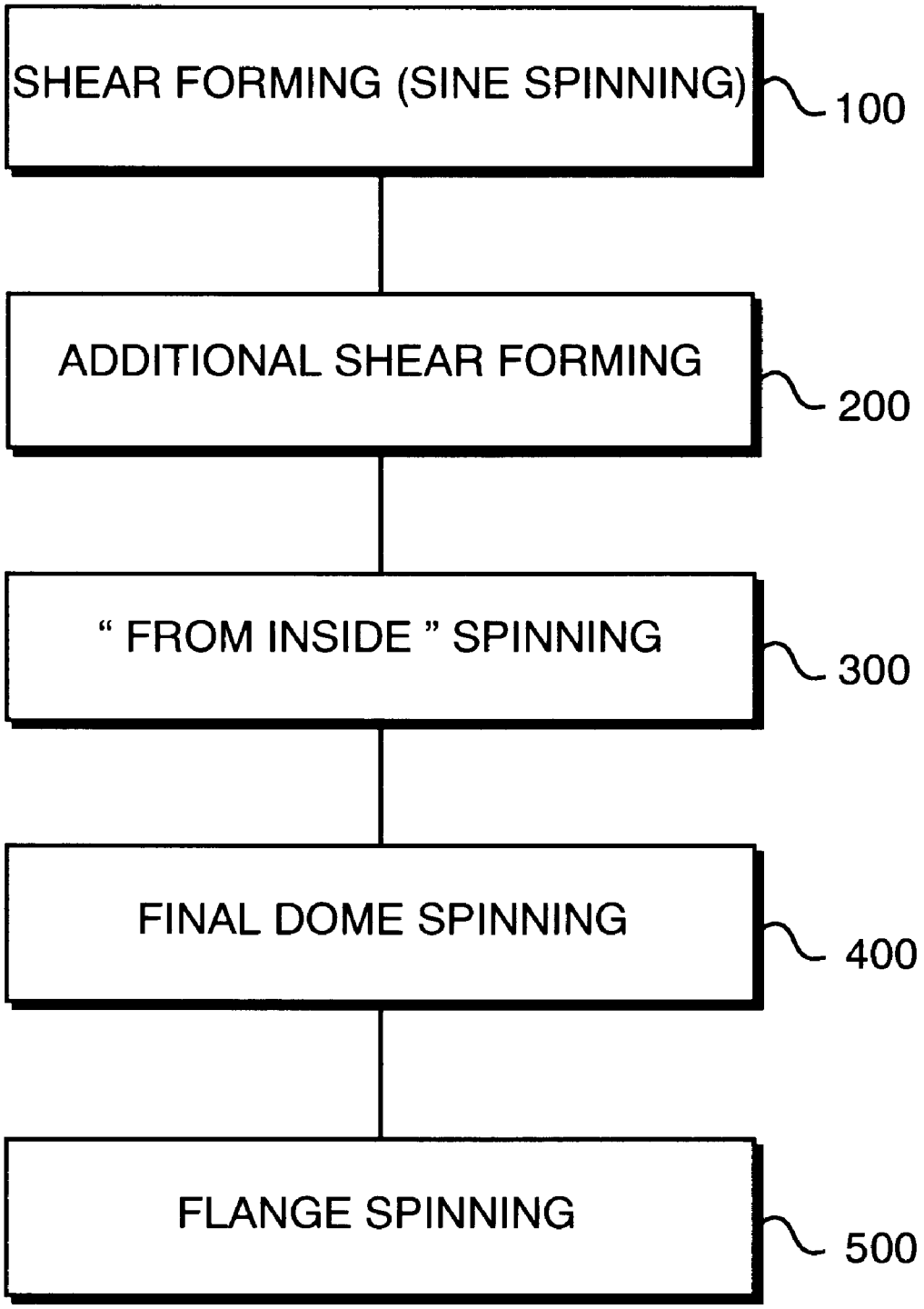
FIG. 4 is a flow chart of the basic embodiment of the method of the present invention.

Referring now to FIG. 4, a flow chart of the basic embodiment of the method of the present invention is shown. The basic embodiment of the method includes the steps of shear forming 100 the blank over a conical mandrel, performing additional shear forming operations 200 for additional thinning in selected areas along its circumference to form a conical shaped blank of varying wall thickness, inside spinning 300 the stretched blank into a concave forming mandrel having a geometry closely representing the final spun dome, final dome spinning 400 the rough dome over a convex forming mandrel into the finished dome, and flange spinning 500 the final spun dome. As will be readily apparent from the foregoing explanation, this method allows a rocket dome having desired mechanical properties to be manufactured from a blank having a surface area smaller than the desired dome surface area and without incurring the high costs of welding multiple blanks or manufacturing and operating an oversized roller to produce oversized blanks.

Figure 5:
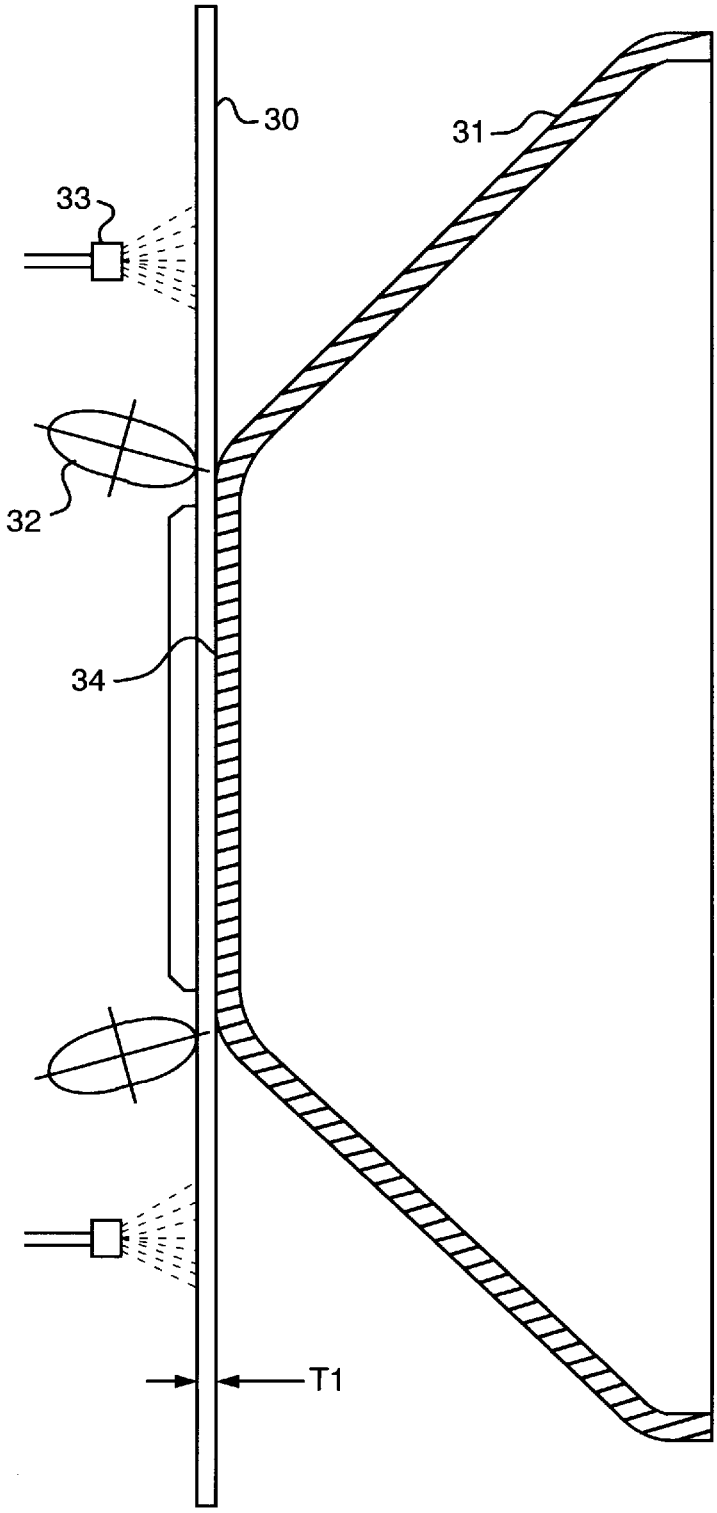
FIG. 5 is a cross sectional view of a raw circular blank coaxially secured to a rotatable flat-nosed conical mandrel prior to performing the shear spinning step of the method of the present invention.

Referring now to FIG. 5, the shear forming step 100 of FIG. 4 is described. The shear forming step 100, also referred to as sine spinning, begins by coaxially securing a metallic circular blank 30 having a thickness $T_1$ to flat-nosed conical mandrel 31. In the preferred method, the circular blank 30 is cut from a single plate of material. Once secured, the blank 30 and the mandrel 31 are coaxially rotated about an axis. As the blank 30 and the mandrel 31 rotate, the blank is heated by a heat source 33 which moves along a track between the outer and inner regions of the circular blank 30. In the preferred embodiment the heat source 33 is a gas torch, but in other embodiments heat may be applied by radiant electrical heat, laser, or other known heating sources capable of heating the blank to a maximum temperature of 700° F. Once the surface of the blank 30 is sufficiently heated, a force is applied to the blank with one or more spinning rollers 32. Spinning rollers are designed to contact the blank 30 such that the roller rolls as the blank is rotated. As the roller rolls, it exerts a force along a band of the surface of the blank and stretches the blank 30. This is accomplished by progressively moving the roller 32 in a tangential direction across the blank 30, starting at the transition point between the flat top portion 34 and the downward sloping side portions of the mandrel 31 and ending at the outside edge of the blank 30. This step 100 results in a deformed blank having a reduced thickness and a shape similar to that of flat-nosed conical mandrel 31.

Figure 6:
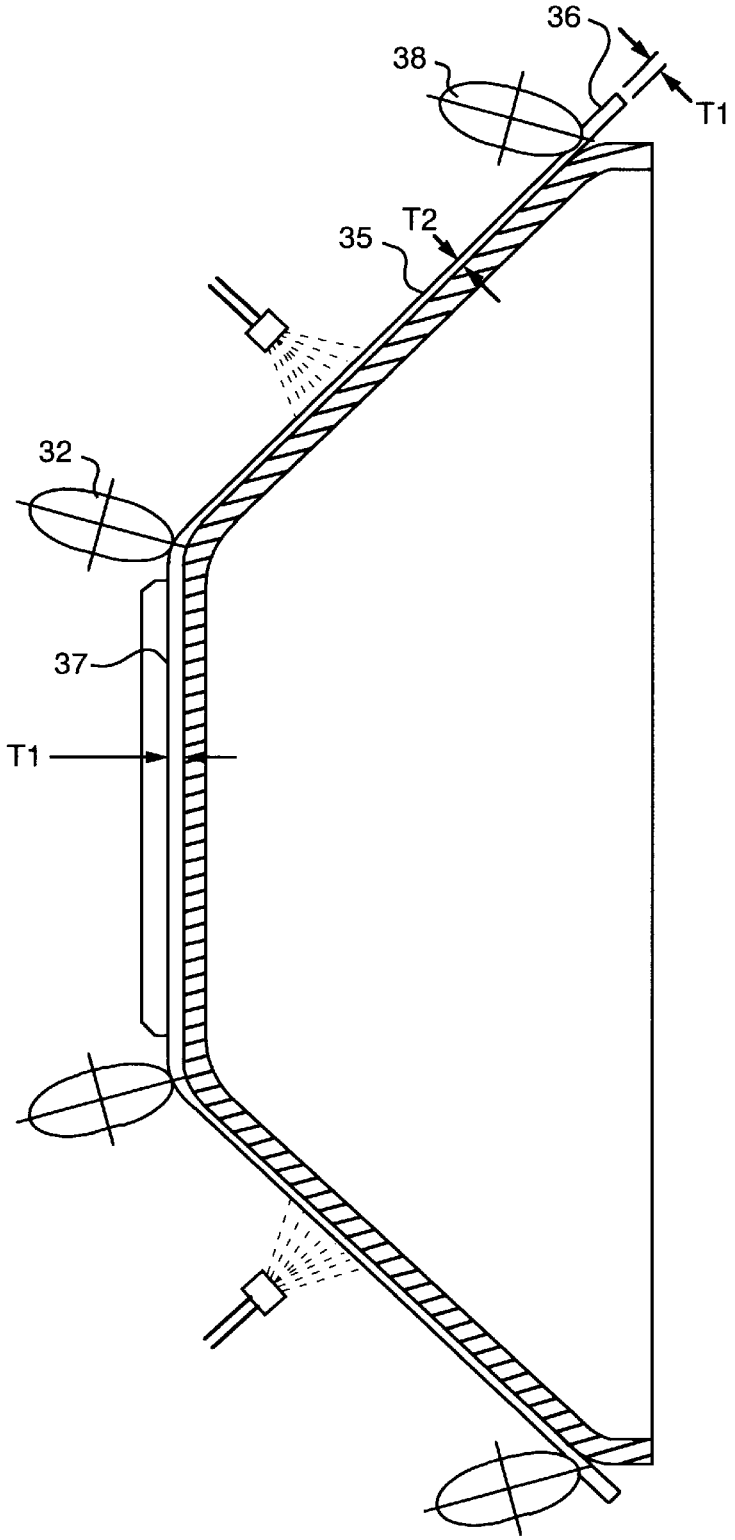
FIG. 6 is a cross sectional view of a shear spun blank coaxially positioned over the rotatable flat nosed conical mandrel after the shear spinning step has been completed.

Referring now to FIG. 6, the additional shear forming step 200 is described. In the preferred embodiment, the additional shear forming step 200 is performed on the same flat-nosed conical mandrel 31 as the initial shear forming step 100, and thus the deformed blank is not removed from the mandrel 31 before the additional shear forming step 200 is performed. However, in some cases, such as where inspection is required between steps, the deformed blank may be removed and require re-attachment to the flat-nosed conical mandrel 31 prior to performing the additional shear forming step 200. Regardless of whether intermediate removal and attachment steps are required the first step in the additional shear forming step 200 is to position heat source 33 at a predetermined point along the conical radius of the deformed blank such that the temperature of the blank is increased along a radial band. Once the radial band of the deformed blank 32 reaches a desired temperature, 500–700 degrees F. being preferred, a force is applied by the roller 32 at another point along the heated radial band. In the preferred embodiment a force of between 5 and 50 tons is applied in the tangential direction in relation to the plane created by the sloping sidewall of the deformed blank. The roller 32 is then progressively moved in a tangential direction such that the desired portion of the sloping sidewall of the deformed blank is stretched again forming a thin walled region 35. In the preferred embodiment, this desired portion comprises the area between the transition point and the flange area at the end of the deformed blank 32 and thus the roller 32 travels to a bottom position 38 and is stopped. As shown in FIG. 6, this additional shear forming step 200 results in a stretched blank having a thickened region 37 around the manhole area having a thickness $T_1$ equal to the thickness of the original blank, a thin walled region 35 having a thickness $T_2$, and a second thickened region 36 around the flange area also having a thickness $T_1$.

Aerospace domes require final contour machining after spin forming. Spun domes are designed to allow for a machining allowance on all surfaces. Typical dome geometry's possess thickened regions at the apex to facilitate bolting of manhole covers and thickened regions at the equator to facilitate attachment of the finish tank into the launch vehicle. The dome membrane is typically very thin. It is in the membrane region that the stretching is performed because of the excess stock on condition. As shown in FIG. 6 the geometry of the stretched blank represents the two thick regions that are substantially equal to the thickness of the starting blank and the thinner cross section along the side wall.

Figure 7:
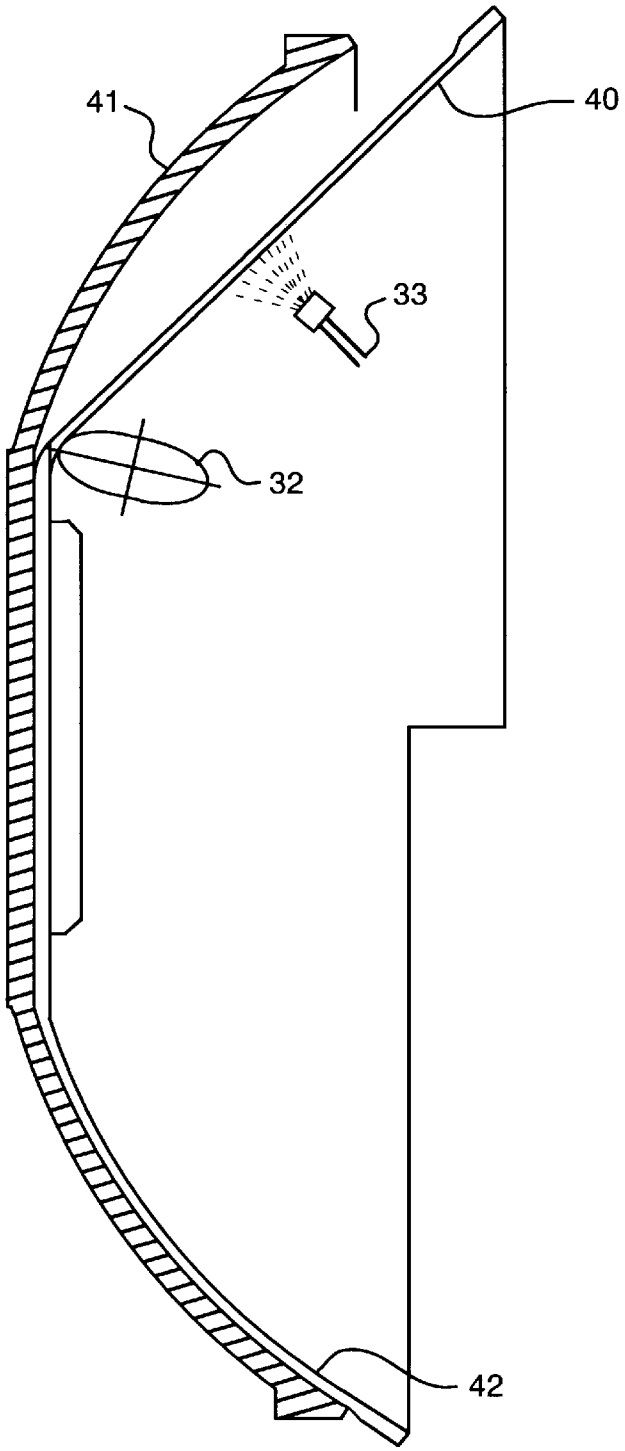
FIG. 7 is a cross sectional view of the shear spun blank positioned within a concave dome mandrel with the left side representing the blank after the inside spinning step had been completed and the right side illustrating the blank during the inside spinning step.

Referring now to FIG. 7, the inside spinning step 300 of the method of the present invention is described. FIG. 7 shows a cross sectional view of the shear spun blank positioned within a concave dome mandrel 41 with the bottom side representing the blank after the inside spinning step had been completed and the top side illustrating the blank during the inside spinning step. After the additional shear-forming step 200 is completed and before the inside-spinning step 300 is performed the shear formed blank is removed from the flat-nosed conical mandrel 31 and is coaxially secured within a rotatable concave mandrel 41. Once secured, the shear-spun blank 40 and concave dome mandrel 41 are rotated and the inner surface of the downwardly sloping sidewalls is heated to a desired temperature by the heat source 33. As the shear spun blank 40 rotates, roller 32 travels over the inner surface of the shear spun blank 40 in a controlled manner to apply a force that reshapes the downwardly sloping sidewalls to the shape of the inner surface of the concave dome mandrel 41 forming a substantially dome shaped blank 42.

Figure 8:
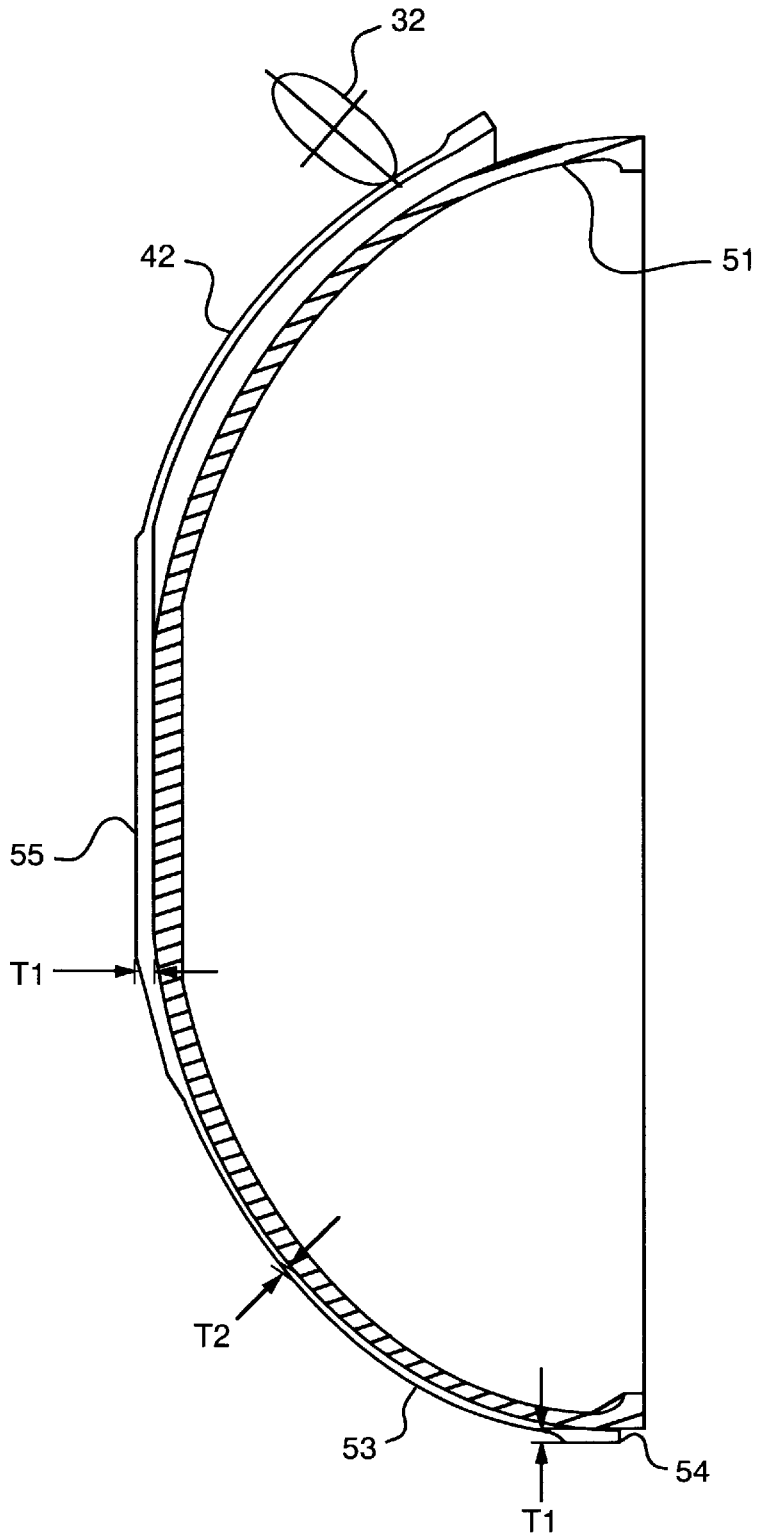
FIG. 8 is a cross sectional view of an inside spun blank positioned on the finish spinning mandrel with the left side representing the blank after the final dome spinning step has been completed and the right side illustrating the blank during the final dome spinning step.

Referring to FIG. 8, the final dome spinning step 400 of the method of the present invention is described. FIG. 8 shows a cross sectional view of an dome shaped blank 42 positioned on the final spinning mandrel with the bottom side representing the finished blank 53 after the final dome spinning step has been completed and the top side illustrating the dome shaped blank 42 during the final dome spinning step.

Figure 9:
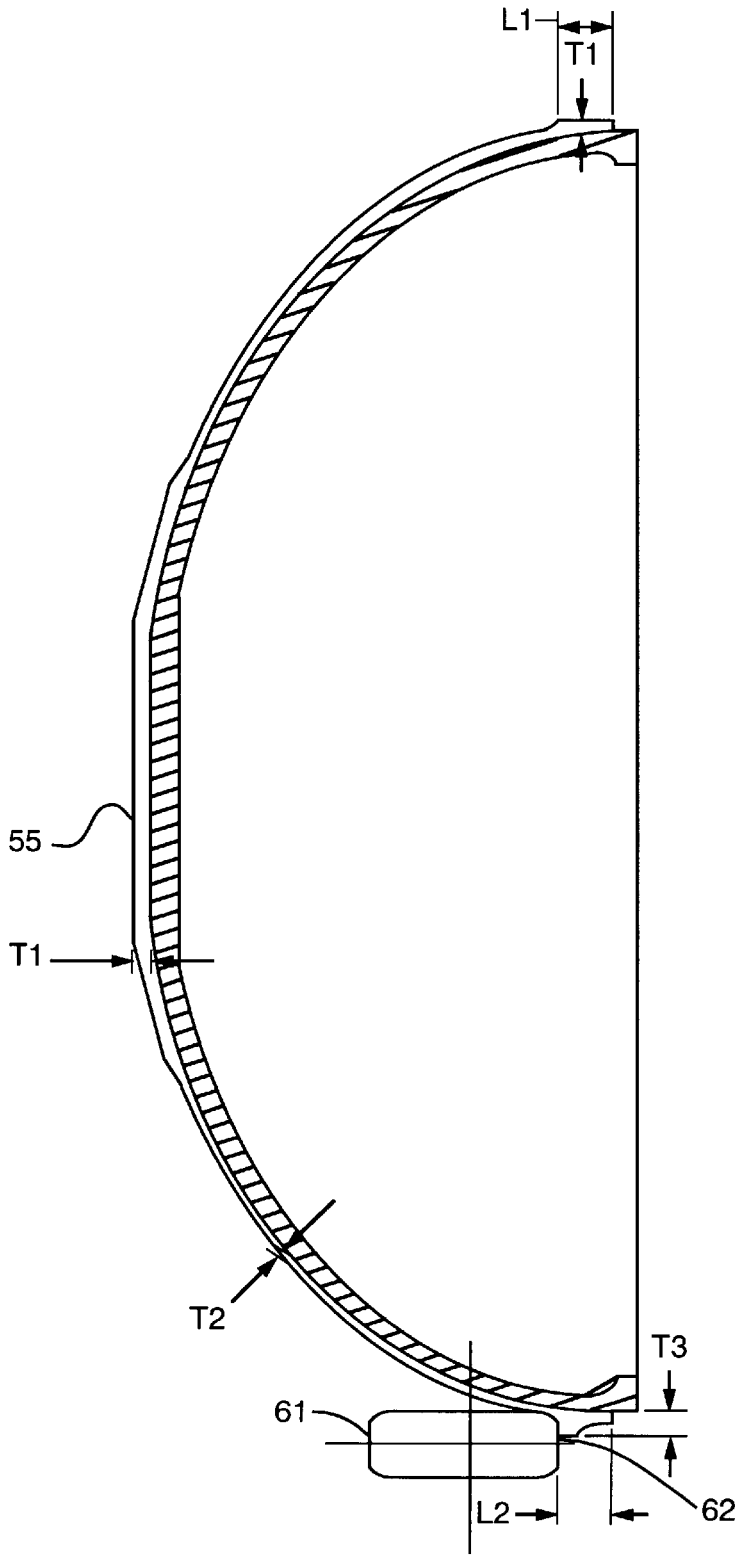
FIG. 9 is a cross sectional view of a final spun blank positioned on the finish spinning mandrel with the left side representing the blank after the flange spinning step has been completed and the right side illustrating the blank during the flange spinning step.

Referring finally to FIG. 9, the flange spinning step 500 is of the method of the present invention is described. The flange spinning step 500 thickens the spun formed dome in the flange area and is performed to compensate for raw material that is on the low end of the starting plate thickness tolerance, or to accommodate an increase in the cross-sectional thickness of the T-flange necessitated by customer requirements. The flange spinning step 500 is performed by rotating a substantially flat faced roller 61 along the flange 62 such that the flange having a greater thickness T3 and smaller length L2 than the thickness T1 and length L1 of the final spun dome.

Once the dome shaped blank 42 is completed, it is removed from concave dome mandrel 41. It is here that two different approaches for aluminum alloys may be taken each resulting in a dome having a different temper.

The first approach involves coaxially mounting the dome shaped blank 42 onto the outside of a convex dome mandrel 51 and spinning the blank 42 at elevated temperature to achieve the final dome geometry. Convex dome mandrel 51 is designed and dimensioned to allow a properly dimensioned, smooth, dome to be formed from dome shaped blank 42. As in the previous spinning steps, the dome shaped blank 42 and the convex dome mandrel 51 coaxially rotate, the heat source 33 heats the outer surface of the blank 42, and roller 32 applies a force to portions of the outer surface of the dome shaped blank 42. This force drives the inner surface of the dome shaped blank into to face-to-face contact with the outer surface of the convex dome mandrel 51. This exertion of this force across the entire surface of the dome shaped blank 42 results in a finished dome 53 of the desired diameter and having a first thickness, T2, in stretched regions of the dome, and a second thickness. T1, in regions where the dome has not been stretched. The finished aluminum dome 53 is subsequently solution and age heat treated to the final mechanical strength of the material, T62 temper being preferred.

The second approach involves solution treating the dome shaped blank 42 after the inside spinning operation and prior to final spinning and performing the final spinning operation at room temperature to provide additional deformation of the material and the induction of cold work to the material. The age heat treatment operation is then performed to further increase the mechanical strength of the dome to a T8 temper. The additional deformation can be achieved at room temperature because the membrane wall is very thin due to the previous shear forming operations, and because the amount of deformation required to bring the dome to the final geometry is minimal due to the design of the concave spinning mandrel. A T8 temper is achieved in part because the amount of cold work deformation is calculated into the design of the concave spinning mandrel.

Although the present invention has been shown and described with respect to several preferred embodiments thereof, various changes, admissions and additions to the form and detail thereof, may be made therein, without departing from the spirit and scope of the invention.

What is claimed is:

1. A method of forming a dome from a substantially round blank wherein a surface area requirement of said dome is greater than a surface area of said blank, said method comprising the steps of:

shear forming said blank, said shear forming step comprising the steps of;

coaxially securing an inside surface of the blank to a rotatable flat-nosed conical mandrel;

rotating said blank on said flat-nosed conical mandrel;

heating a predetermined portion of said blank; and applying a force to an outer surface of said blank such that said blank is shear formed in a shape of said flat-nosed conical mandrel to form a deformed blank;

additional shear forming said deformed blank in predetermined locations such that a thickness of said blank in said predetermined locations is reduced to form a stretched blank;

removing said stretched blank from said mandrel;

inside spinning said stretched blank to form a dome shaped blank, said inside spinning step comprising the steps of;

coaxially securing an outside surface of said stretched blank within a rotatable concave dome mandrel;

rotating said stretched blank on said concave dome mandrel;

heating a predetermined portion of said stretched blank; and applying a force to an inner surface of said stretched blank such that said stretched blank is deformed to form said dome shaped blank;

removing said dome shaped blank from said concave dome mandrel;

final dome spinning said dome shaped blank into said dome, said final dome spinning step comprising the steps of;

coaxially securing an inside surface of said dome shaped blank to a rotatable convex dome mandrel;

rotating said dome shaped blank on said convex dome mandrel;

heating a predetermined portion of said dome shaped blank; and applying a force to said outside surface of said dome shaped blank such that said dome shaped blank is deformed in a shape of said convex dome mandrel to form said dome; and flange spinning said dome, said flange spinning step comprising the steps of:

rotating said dome shaped blank on said convex dome mandrel;

heating a flange portion of said dome shaped blank; and applying a force to a surface of said range portion such that said flange portion is deformed such that a thickness of said flange is increased and such that a length of said flange is decreased.

2. The method as claimed in claim 1 wherein said step of additional shear forming said deformed blank in predetermined locations comprises the steps of:

heating a predetermined portion of said deformed blank;

applying a force to an outside surface of said deformed blank such that a thickness of said predetermined portion of said deformed blank is decreased and such that the surface area of said stretched blank is greater than the surface area of said deformed blank.

3. The method as claimed in claim 2, wherein each of said steps of applying a force comprises applying a force with a roller.

4. The method as claimed in claim 3 wherein said step of applying a force to said outside surface of said deformed blank comprises applying a force having a vector of between 5 and 50 ton in relation to said outside surface of said deformed blank.

5. The method as claimed in claim 2 wherein each of said heating steps comprises heating to a temperature of a maximum of 700 degrees Fahrenheit.

6. The method as claimed in claim 1, further comprising the step of annealing said substantially round blank.

7. The method as claimed in claim 1 further comprising the step of solution heat treating said dome.

8. The method as claimed in claim 1 further comprising the step of age heat treating said dome.

9. The method as claimed in claim 1 wherein said dome is an aluminum alloy, and wherein said method further comprises the steps of solution heat treating and age heat treating said dome to a T62 temper.

10. A method of forming a dome from a substantially round blank wherein a surface area requirement of said dome is greater than the surface area of said blank, said method comprising the steps of:

shear forming said blank, said shear forming step comprising the steps of;

coaxially securing an inside surface of the blank to a rotatable flat-nosed conical mandrel;

rotating said blank on said flat-nosed conical mandrel;

heating a predetermined portion of said blank; and applying a force to an outer surface of said blank such that said blank is shear formed in a shape of said flat-nosed conical mandrel to form a deformed blank;

additional shear forming said deformed blank in predetermined locations such that a thickness of said deformed blank in said predetermined locations is reduced to form a stretched blank;

removing said stretched blank from said mandrel;

inside spinning said stretched blank to form a dome shaped blank, said inside spinning step comprising the steps of;

coaxially securing an outside surface of said stretched blank within a rotatable concave dome mandrel;

rotating said stretched blank on said concave dome mandrel;

heating a predetermined portion of said stretched blank;

applying a force to an inner surface of said stretched blank such that said stretched blank is deformed to form said dome shaped blank;

removing said dome shaped blank from said concave dome mandrel;

solution heat treating said dome shaped blank; and final dome spinning said dome shaped blank into said dome, said finish spinning step comprising the steps of;

coaxially securing the inside surface of said dome shaped blank to a rotatable convex dome mandrel;

rotating said dome shaped blank on said convex dome mandrel; and applying a force to said outside surface of said dome shaped blank such that said dome shaped blank is deformed in a shape of said convex dome mandrel to form said dome; and flange spinning said dome, said flange spinning step comprising the steps of:

rotating said dome shaped blank on said convex dome mandrel;

heating a flange portion of said dome shaped blank; and applying a force to a surface of said flange portion such that said flange portion is deformed such that a thickness of said flange is increased and such that a length of said flange is decreased.

11. The method as claimed in claim 10 wherein said step of additional shear forming said deformed blank in predetermined locations comprises the steps of:

heating a predetermined portion of said deformed blank;

applying a force to an outside surface of said deformed blank such that a thickness of said predetermined portion of said deformed blank is decreased and such that the surface area of said stretched blank is greater than the surface area of said deformed blank.

12. The method as claimed in claim 11, wherein each of said steps of applying a force comprises applying a force with a roller.

13. The method as claimed in claim 12 wherein said step of applying a force to said outside surface of said deformed blank of said spin stretching step comprises applying a force having a vector of between 5 and 50 ton in relation to said outside surface of said deformed blank.

14. The method as claimed in claim 11 wherein each of said heating steps comprises heating to a temperature of a maximum of 700 degrees Fahrenheit.

15. The method as claimed in claim 10, further comprising the step of annealing said substantially round blank.

16. The method as claimed in claim 10 further comprising the step of age heat treating said dome.

17. The method as claimed in claim 16 wherein said dome is an aluminum alloy and said step of age heat treating said dome comprises age heat treating said dome to a T8 temper.

* * * * *